United States Patent [19]

Lewis et al.

[11] Patent Number: 4,699,062

[45] Date of Patent: Oct. 13, 1987

[54] VLA (ALWT) AIRFRAME CLAMSHELL OPENER ASSEMBLY

[75] Inventors: Thomas L. Lewis, Solana Beach; Edward H. Stiles, San Diego, both of Calif.

[73] Assignee: The United States of America as Represented by the Secretary of the Navy, Washington, D.C.

[21] Appl. No.: 15,391

[22] Filed: Feb. 11, 1987

[51] Int. Cl.[4] ..... F42B 15/10

[52] U.S. Cl. ..... 102/378; 102/293

[58] Field of Search ..... 102/293, 377, 378, 393, 102/489

[56] References Cited

U.S. PATENT DOCUMENTS

| | | | |
|---|---|---|---|
| 3,352,192 | 11/1967 | Webb | 102/378 |
| 3,453,960 | 7/1969 | Qualls | 102/378 |
| 3,636,877 | 1/1972 | Eaton, Jr. | 102/378 |
| 3,706,281 | 12/1972 | Hatakeyama | 102/378 |
| 3,752,078 | 8/1973 | Stump | 102/378 |
| 3,754,725 | 8/1973 | Kartzmark et al. | 102/378 |
| 3,867,893 | 2/1975 | Saholt et al. | 102/378 |
| 3,975,981 | 8/1976 | Seifert | 102/378 |

*Primary Examiner*—Charles T. Jordan

*Attorney, Agent, or Firm*—Ervin F. Johnston; Thomas G. Keough

[57] ABSTRACT

A missile having a payload mounted on an airframe includes a pair of wave shaped springs for separating the payload from the airframe at a predetermined time in the flight envelope. Hinged clamshell-half fairing members in the airframe support the payload during the initial stages of deployment by a rocket motor. At the predetermined time an explosive band separation device is actuated so that the pair of diametrically disposed wave-shaped springs can force the clamshell-half fairing members apart and into the slipstream to disengage the airframe from the payload to assure its intended deployment.

5 Claims, 5 Drawing Figures

FIG. 2
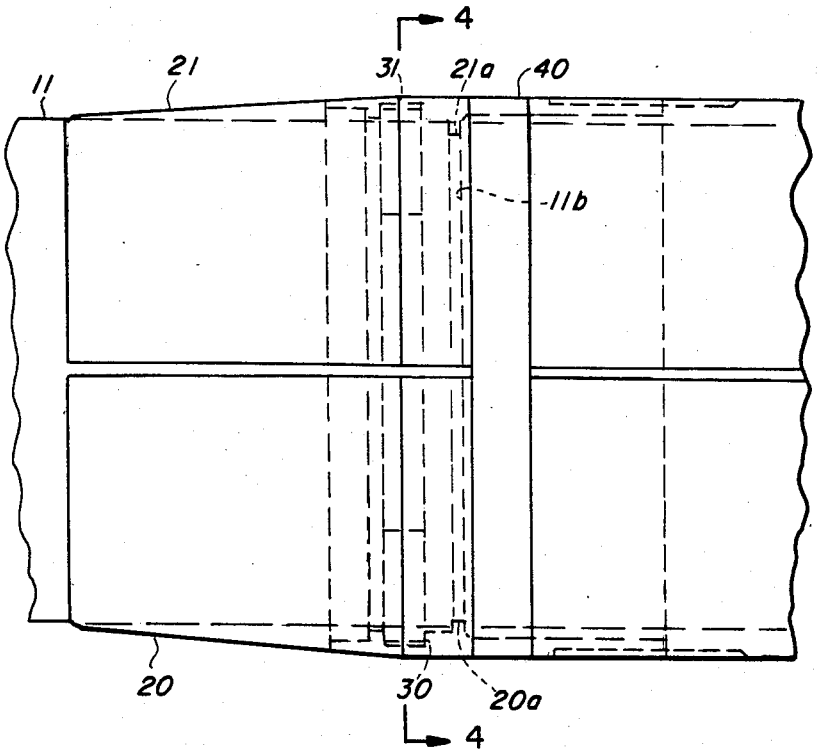
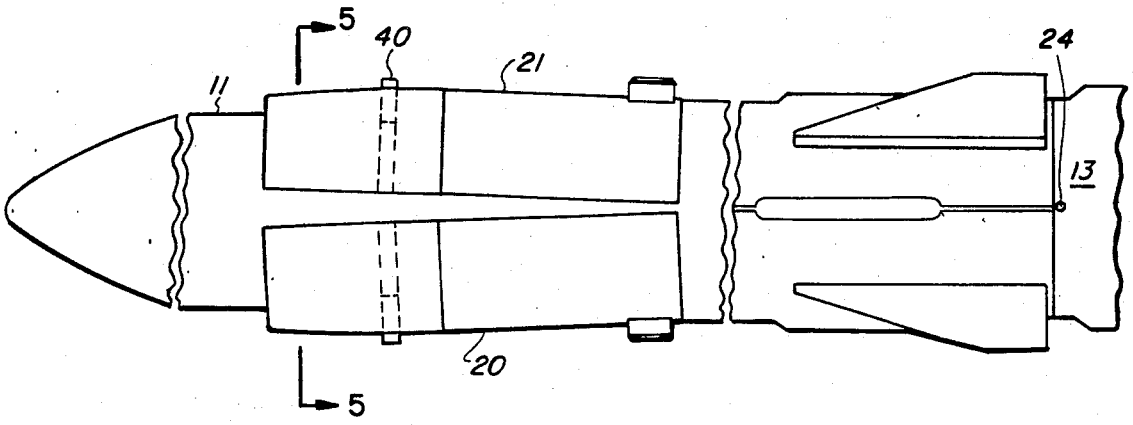
FIG. 3

VLA (ALWT) AIRFRAME CLAMSHELL OPENER ASSEMBLY

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

Various techniques and devices for improving the effectiveness of missiles continuously have evolved since missiles were first developed. As a consequence, rocket boosters and airframes place ordnance or instrumentation packages much more precisely than previously envisioned. Typically, a payload is mounted on an airframe which is propelled by a rocket or a rocket booster. The airframe and payload can be ballistically deployed or a controlled guidance can be effected by proper actuation of the motor and suitable control surfaces. Usually, a missile accelerates and velocity increases until the rocket motor thrust ends. The missile continues in an essentially ballistic trajectory until a predetermined command initiates separation of the airframe and payload somewhere along the flight envelope. Separation of the airframe from the payload usually occurs so that the payload is free to accomplish the intended purpose. Separation is accomplished by a variety of well known means, such as, an explosive band cutter that severs a pretensioned band holding the payload and airframe together. Typical of such an arrangement is that shown in the U.S. patent entitled "Rocket-Thrown Missile" of U.S. Pat. No. 3,867,893. Explosive bolt devices and banding are used to hold motors and successive stages together. Helical ejection springs ensure that bivalvular members open away from a payload after the banding has been ruptured. The helical spring was suitable for this design where space limitations were not overly critical. Another clamping arrangement to hold payload and airframe together was shown by Roy M. Kartzmark et al in their U.S. Pat. No. 3,754,725. A tensioning band holds hinged semicircular shells onto a payload and an ejection spring arrangement biases the front end of the shell members apart. The details of the ejection spring arrangement were not shown. From the configuration of this missile it appears that there are no overly critical space constraints between the shells and the missile so that the helical arrangement of the aforecited patent could well be the chosen design.

Thus, there exists in the state-of-the-art a continuing need for a compact biasing arrangement for urging the clamshell-like airframe members from engagement with a missile that is configured to be confined within a small annular space about the payload so as not to interfere with other missile components.

SUMMARY OF THE INVENTION

The present invention is directed to providing an improvement for a missile having a payload and an airframe including a pair of clamshell-half sections engaging the payload. A pair of wave-shaped springs are located in an annular space between the payload and the two chamshall-half sections. Upon actuation of a pretensioned band separation device, the springs move the clamshell-half sections apart so that the slipstream catches them and further rotates them about a hinge to free the payload from the missile airframe.

A prime object of the invention is to provide for an improved means for assuring the disengagement of a payload from a missile airframe.

Yet another object is to provide for biasing springs for urging the separation of a missile airframe from its payload being configured to occupy a small annular space about the payload.

Yet another object of the invention is to provide for a pair of resilient members disposed about a missile payload for urging a supporting airframe away from the payload in a radially outwardly diverging direction.

Still yet a further object of the invention to to provide for a pair of wave-shaped springs disposed in a small annular space at diametric locations about a payload for pushing a pair of clamshell-like airframe members apart during separation of the payload from the airframe.

These and other objects of the invention will become more readily apparent from the ensuing specification when taken in conjunction with the appended drawings and the attached claims.

BRIEF DESCRIPTION OF THE DRAWINGS

FIG. 2 is an expanded view of the two clamshall-half members of the airframe engaging the payload with the diametrically disposed wave springs urging separation.

FIG. 3 is a view of the clamshell-like member-payload interface depicting the wave springs effecting diametrically opposed divergent displacement.

DESCRIPTION OF THE PREFERRED EMBODIMENT

Figure 1:
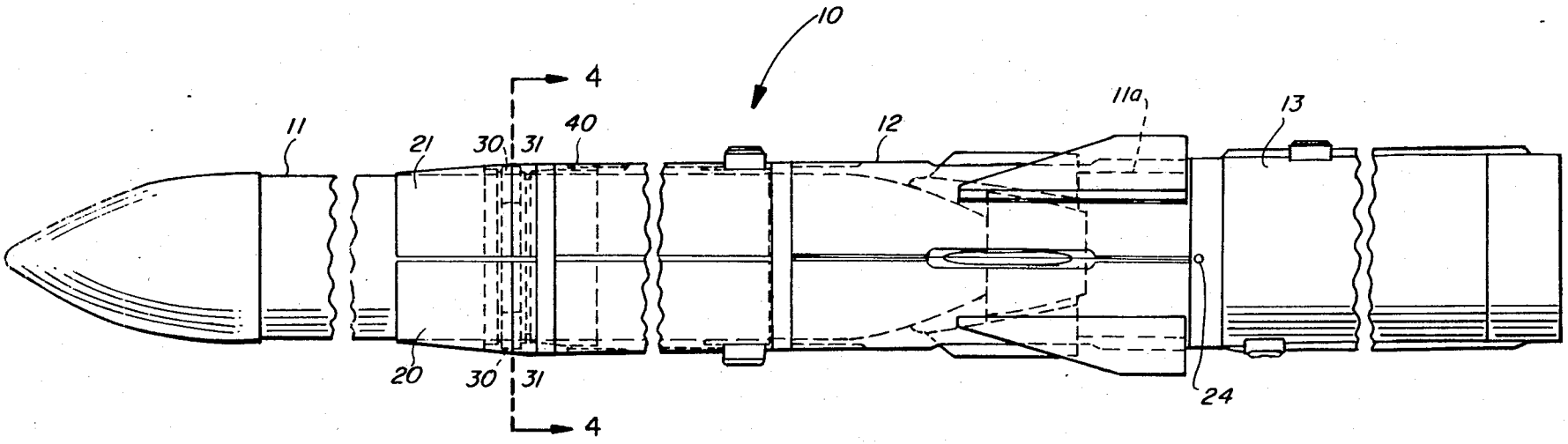
FIG. 1 is a side view of partially in cross-section of a missile having a rocket propelling an airframe that carries a payload.

Referring now to FIG. 1 of the drawings, a missile 10 is shown as it operationally deploys a payload 11 to a remote designated area. An airframe 12 is interconnected to the payload in a manner to be elaborated on below and a rocket propellant or booster section 13 is secured to the airframe to reliably carry it to its destination.

Missile payload 11 can be an instrumentation package or variety of ordnance such as a torpedo. The embodiment shown in FIG. 1 depicts a homing torpedo having a cannister 11*a* which contains, for example, a drogue chute or parachute to reduce the impact of the torpedo's entry into the water. The payload and cannister are held within clamshell fairing members 20 and 21 of airframe 12 by suitable mounting surfaces which engage the payload's outer configuration. The clamshell fairing members have an essentially semicylindrical shell-shape. These are provided with semicircular rims 20*a* and 20*b* on the forward section of the fairing members to fit into a mating annular groove 11*b* on payload 11. FIG. 2 shows an annular groove 11*b* on the torpedo mechanically cooperates with the annular rims 20*a* and 21*a* on the clamshell fairing members to at least partially transfer axial thrust forces between airframe 12 and torpedo payload 11 as the rocket accelerates it and directs it to a distant impact area. This circumferential loading on the fairing helps retain aerodynamic alignments during flight.

A pair of diametrically opposed hinge pins, only one of which, 24, is shown in FIGS. 1 and 3 provide a journaling support for the two clamshell fairing members on the structure of the airframe associated with rocket booster 13. The exact details of the journaled interconnection are not shown in detail since such a mounting arrangement has been well established in this particular art and is obvious to a routineer.

The clamshell-shaped fairing and the torpedo payload present a aerodynamically-clean design. The close-fitting fairing members and the torpedo are so designed also to facilitate handling and to allow a vertical launching of the missile. Vertical launch constraints and compact packaging considerations called for by a high-density ordnance capability necessitate that a missile's design be compact and very space efficient.

The improvement of this invention facilitates improved missile design by the location of a pair of wave-shaped springs 30 and 31 in a small annular space 3031 about the torpedo of the payload. The wave shaped springs provide the necessary radial push to force the clamshell-shaped fairing members into the slipstream. As the fairing members are pushed outwardly into the slipstream created as the missile passes through the air, slipstream airflow rotates the two clamshell-shaped fairing members about hinge pins 24. This rotation presents a larger drag on the airframe and booster to slow it so that the payload separates and is free to travel onward toward the target because of its more streamlined aerodynamic shape.

The two wave-shaped springs 30 and 31 are fabricated from the high strength corrosion resistant steel strips such as heat treated 17-7 stainless steel or INCONNEL 718 high strength steel for example. Either of these metals or their equivalents can be shaped into a wave-shaped configuration that has about a 450 pound deflection force that can push the clamshell-shaped fairing members outwardly about one-half inch. This amount of travel creates an opening that is sufficient for slipstream to rotate the fairing members about the hinge pins so that the payload is free to travel onward to the target. The springs are held in compression by a pretensioned band 40 that encircles the clamshell fairing members and the missile. When the band is cut by a suitably programmed cutter the springs can force the shells apart.

It is to the essence of this inventive concept that a reliable outwardly pushing force is provided by the two diametrically opposed wave-shaped springs. The springs are compactly and conveniently mounted in a small annular space about the payload. A typical missile which would include these springs is a missile having a 14.1 inch outer diameter which contains a torpedo having a 12.75 inch diameter. The walls of the clamshell-shaped fairing members in the region, where the wave shaped springs are located, has a wall thickness of about one quarter of an inch so that the space separating the payload from the inner surface of the fairing members is about four tenths of an inch.

Figure 4:
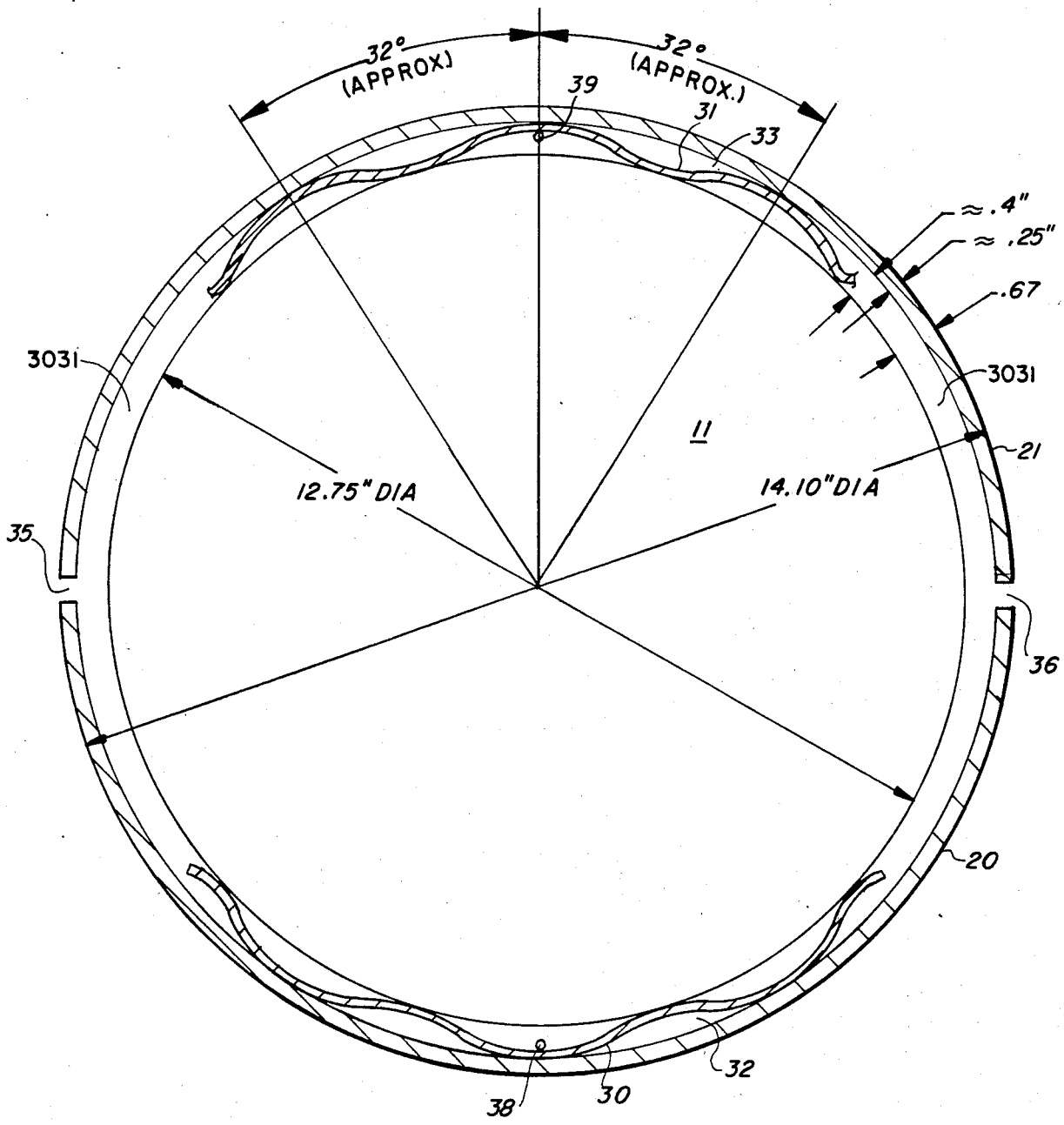
FIG. 4 shows a cross-sectional view taken generally along the lines 4—4 in FIG. 2.
Figure 5:
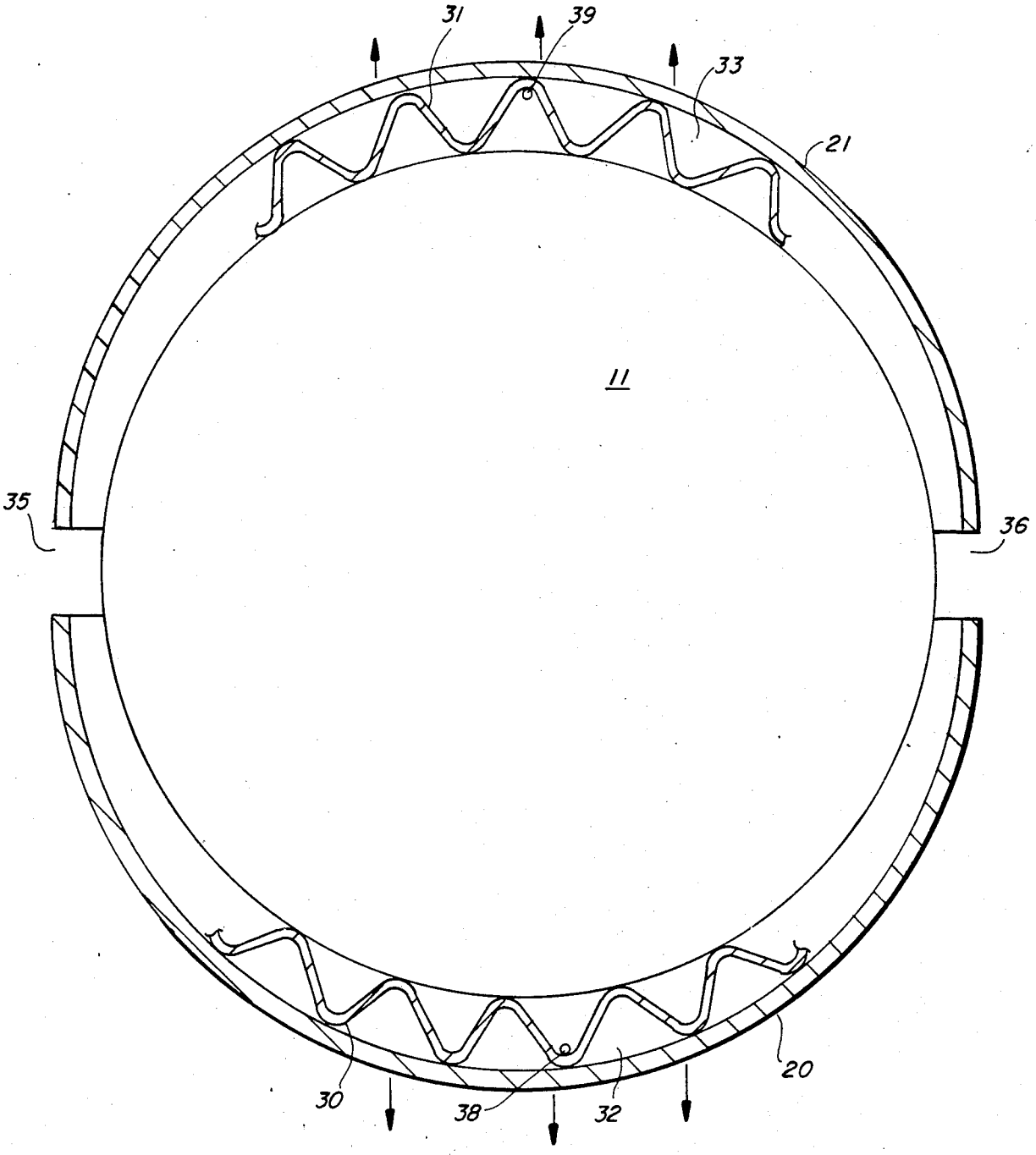
FIG. 5 depicts a cross-sectional view of the invention taken generally along lines 5—5 in FIG. 3.

A pair of wave shaped springs are mounted at diametrically opposed locations 32 and 33 in the annular space 3031 which are quadrature spaced from the separations 35 and 36 between the adjacent clamshell-shaped fairing members, note FIGS. 4 and 5. Having the wave-shaped springs span a fairing bearing contact surface spanning an angle of approximately thirty-two degrees avoids the build up of a binding force which might otherwise be caused if the wave shaped spring members wrapped too far about the payload. In other words, if the wave-shaped springs were located more closely to the proximity of the separations 35 and 36, they might bind the clamshell fairing members to the payload and actually impede separation of the airframe from the payload. Thus, it had been found better to include the wave-shaped springs as mentioned to avoid this limitation.

This method of forcing the airframe separation over existing methods is reliable because of its simplicity and that this configuration fits into the available space whereas the contemporary helical spring arrangements don't. There are only two component parts, both wave springs, whereas the other spring biasing arrangements had a number of them which influenced reliability. Noting FIGS. 4 and 5 a pair of retainer pins 38 and 39 optionally may be included to keep the springs connected or retained to the shells during missile assembly. This may avoid damage to the payload that might otherwise be caused by misalignment of the springs.

Obviously, many modifications and variations of the present invention are possible in the light of the above teachings. It is therefore to be understood that within the scope of the appended claims the invention may be practiced otherwise than as specifically described.

We claim:

1. An apparatus for assuring the separation of a missile payload from an airframe having a pair of clamshell-shaped fairing members engaging the missile comprising:

means for providing an annular space between the missile payload and the clamshell-shaped fairing member and at least one wave shaped spring compressively disposed in the annular space providing means for exerting a radially outwardly directed force to separate the clamshell-shaped fairing member for the missile payload.

2. An apparatus according to claim 1 in which the wave-shaped spring is located to exert its radially outwardly directed force on a lateral midpoint of one of the clamshell-shaped fairing members.

3. An apparatus according to claim 2 further including:

a pair of wave-shaped springs each on diametrically opposed part of the payload and each exerting on a separate fairing member.

4. An apparatus according to claim 3 further including:

a retainer pin securing each wave shaped spring to a fairing member.

5. An apparatus according to claim 4 in which each of the wave shaped spring is located at a lateral midpoint of each fairing member to avoid binding.

* * * * *